United States Patent [19]

Morton

[11] Patent Number: 4,644,732

[45] Date of Patent: Feb. 24, 1987

[54] EASY OPENING, DISPOSABLE CONDIMENT CONTAINER

[75] Inventor: Jay Morton, Miami Beach, Fla.

[73] Assignee: Lumo, Inc., Miami, Fla.

[21] Appl. No.: 763,622

[22] Filed: Aug. 8, 1985

[51] Int. Cl.[4] ..... B65B 61/18

[52] U.S. Cl. ..... 53/412; 53/459; 206/613; 206/629; 383/121

[58] Field of Search ..... 53/455, 456, 459, 462, 53/463, 412; 383/121; 206/610, 613, 628, 629

[56] References Cited

U.S. PATENT DOCUMENTS 3,834,113 9/1974 Howe et al. ..... 53/412

*Primary Examiner*—John Sipos

*Assistant Examiner*—Donald R. Studebaker

*Attorney, Agent, or Firm*—Richard C. Litman

[57] ABSTRACT

A disposable, portion controlled container for condiments and other comestibles formed from heat sealable material is disclosed, featuring an easy opening of the container by virtue of a unique fold and heat seal made at one corner of the container during manufacture. An inside reverse fold is made in one corner of the container and a heat seal made along a four thickness layer of this inside reverse fold defines a tear line, stronger than the adjacent material. A tab extended from this four thickness heat seal of the inside reverse fold provides the means for opening the container along the tear line. The size of the opening in the container is controlled by the initial width of material used to form the inside reverse fold.

6 Claims, 20 Drawing Figures

EASY OPENING, DISPOSABLE CONDIMENT CONTAINER

BACKGROUND OF THE INVENTION

The advent of the fast food industry, airline meals, and unit dose packaging of medicines has created another industry devoted to the convenient packaging of ketchup, relish, mustard and other condiments as well as medicines and other liquid or semi-solid contents. These materials are dispensed in disposable, portion controlled containers formed from thermoplastic or thermoplastic coated materials which are heat sealed to form a container for the desired contents.

The difficulty with prior art disposable condiment containers lies in the fact that they are hard to open neatly. A disposable ketchup container, for example when torn open is apt to dispense its contents all at once, and control of the opening for dispensing the contents is random depending on the tear which the user makes. The present invention contemplates an easy opening, disposable condiment container which provides a controlled opening into the contents so that they may be evenly and neatly disbursed by forming the container with an opening means which may be controlled in size at the time of manufacture to suit the intended contents. The opening means disclosed may be employed for contents as thick as relish or as thin as cough medicine with equal success.

This easy opening feature of the present invention is achieved by making the container with an inside reverse fold at one corner and heat sealing the fold along the diagonal edge of the fold providing a four thickness layer of material at that edge and extending the reverse fold beyond the portion of the container use to hold the contents to provide an opening tab. When the opening tab is pulled the container is torn along the sealed diagonal of the inside reverse fold providing an opening having a predetermined diameter suitable for proper dispensing of the contents.

PRIOR ART

The inside reverse fold described in the present invention is well known to students of the oriental paper folding art of Origami. It has also been extensively employed in the manufacture of food containers, but as a way of forming and sealing the container rather than opening the container. The cardboard milk carton, such as that described by Braun in U.S. Pat. No. 4,279,675 and by others in many other patents, employs two inside reverse folds in the making but does not seal them along the line contemplated by the present invention. The inside reverse fold of the milk carton, when opened by tearing, provides a pouring spout for dispensing the contents rather than the controlled opening described herein. Other inventors such as G. Meyer-Jagenberg in U.S. Pat. No. 3,280,531 have employed the inside reverse fold as a method of forming, but not of opening the container. It has also found extensive use in the forming and sealing of containers for solid materials such as those packages described by Griner in U.S. Pat. No. 3,403,033 and Lakso in U.S. Pat. No. 2,307,890. Again, neither these or any other prior art known to the applicant employs the inside reverse fold as the method of opening the container and providing an opening of controlled size for dispensing the contents.

SUMMARY OF THE INVENTION

The present invention discloses a disposable, portion controlled, easy opening container for foodstuffs and medicines formed by folding and heat sealing a suitable thermoplastic or thermoplastic material and providing an inside reverse fold of the material at one corner of the container. The inside reverse fold is sealed along the diagonal crease fold of the inside reverse fold and extends beyond the part of the container holding the contents. The extended portion of the inside reverse fold provides a tab for pulling to open the container while the four thickness heat sealed material along the diagonal crease fold provides a tear line for access to the contents. The extended tab may be concealed to provide a container which may be formed and handled as readily as disposable portion controlled containers without opening means are handled or it may be exposed to provide a visible opening means.

Other objects, advantages and the features of the invention will become apparent from the following description taken together with the accompanying drawings.

BRIEF DESCRIPTION OF THE DRAWINGS

Referring now to the drawings wherein like numbers are used to describe like parts, the following is a brief description of each of the several drawings.

DESCRIPTION OF THE PREFERRED EMBODIMENTS

Figure 1:
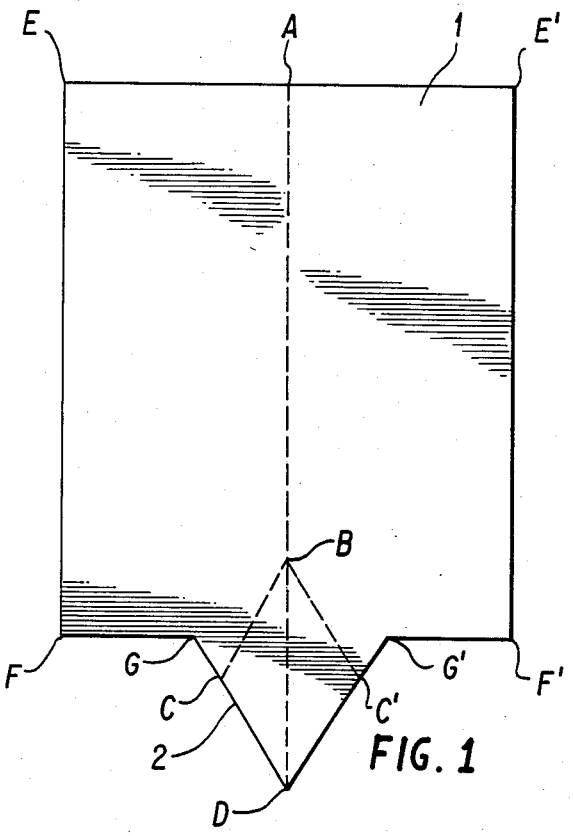
FIG. 1 is a view of a die cut blank for forming a condiment container.

Referring now to the drawings and in particular to FIG. 1, there is shown a blank 1 of a heat - sealable, moisture impervious, thermoplastic or thermoplastic coated material, suitable for the containment of condiments, comestibles, medicines or other liquid or viscous contents. The letters employed on the drawing are for purposes of describing the various folds which will be made in the process of forming the easy opening, disposable condiment container.

A description of the several folds employed to form the condiment container can best be understood by using, in this description, some standardized terminology for the types of folds, the terminology being borrowed from the literature on the paper folding art of Origami. A valley fold is a fold made with the edges of the figure shown on the drawing coming outward from the drawing; a mountain or peak fold is a fold made with the edges of the figure shown on the drawing going inward toward the drawing, and a crease fold is a fold which may be made in either or both directions. An inside reverse fold, which will be employed in forming the condiment container and later described, is a fold made with a combination of these three basic folds.

Figure 3:
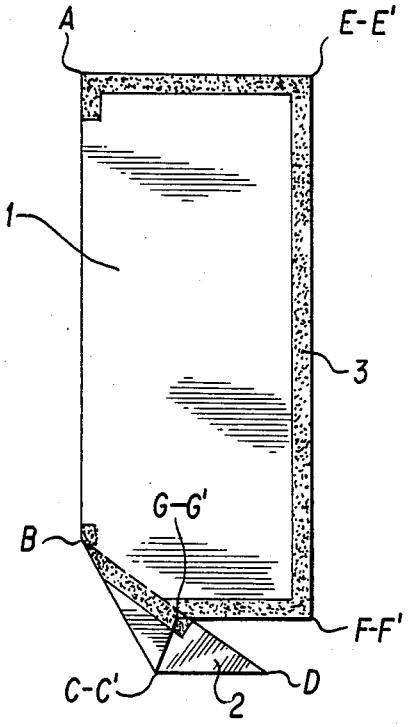
FIG. 3 shows the heat sealed condiment container.
Figure 2:
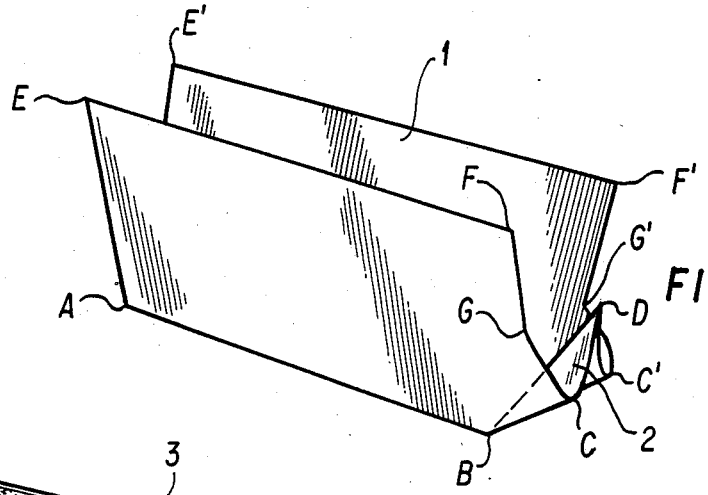
FIG. 2 is a view showing the folding step forming the inside reverse fold.
Figure 4:
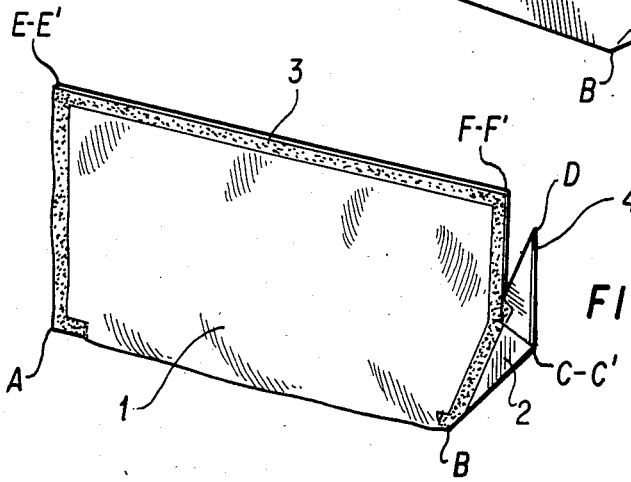
FIG. 4 is perspective view of the filled condiment container.

There are shown in FIG. 1 the various edges and fold lines which will be used to form the final condiment container as will be detailed and which are described in FIGS. 2, 3 and 4. The blank 1 is preferably cut from a roll of thermoplastic or thermoplastic coated material suitable for heat sealing and will have exterior corners E and E′ and F and F′. A triangular, die cut section 2 extends from one edge of the center of the blank 1. The base of the triangle G—G′ will be twice the width of the desired opening in the condiment container, after opening. For thick or semi - solid comestibles such as relish, the desired opening will be wider than that required for liquids or more fluent contents such as ketchup, syrups and the like.

The condiment container is formed in the manner shown in FIG. 2 by making a valley fold along the line A-B, a crease fold along the line B-D, and valley folds along the lines B-C and B-C′. As the corners E—E′ and F—F′ are brought together along the valley fold A-B the crease fold B-D is used as a peak or mountain fold, which when combined with the valley folds along B-C and B-C′ creates an inside reverse fold along the line B-D.

With these folds completed as shown in FIG. 3, the condiment container is sealed with a tube closure heat seal along the line E—E′—F—F′ and heat seals along the lines B-G—G′, G—G′-F—F′, and after filling with the desired contents, along the line A-E—E′ as shown by the shaded heat seal lines 3 in FIGS. 3 and 4.

The use of the inside reverse fold maintains the inner surface of the material used to make the container in contact with the contents so that the construction is suitable for coated or printed containers which may have exterior surfaces which should not contact food.

Inspection of FIGS. 2 and 3 will disclose that the inside reverse fold, made along B-G—G′ has resulted in four thicknesses of the plastic sheet material being brought together and heat sealed together with an inside reverse fold as one element of the condiment container, while all of the other heat seals made involve only two thicknesses of the plastic sheet material. The easy opening feature of this condiment container is provided by this inside reverse fold, and the additional strength of the four thickness heat sealed seam along the material at B-G—G′. It is to be noted that this heat seal is only made along the line which has four thicknesses of material and does *not* extend into the inside wall of the condiment container.

When the tab 4 shown in FIG. 3 is pulled, to open in the condiment container, the plastic material will be torn along the inside edge of the heat seal along the tear line B-G—G′ because the four thicknesses of material along that line are very much stronger than the individual thickness of material enclosing the contents. This provides an easy opening condiment container, with a neatly defined opening from which the contents of the condiment container may be dispensed.

Figure 5:
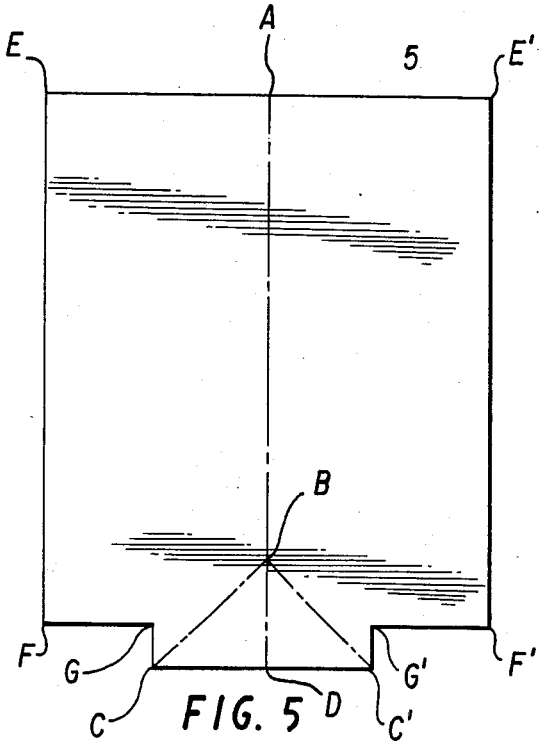
FIG. 5 is a view of an alternate die cut blank for forming a condiment container.
Figure 6:
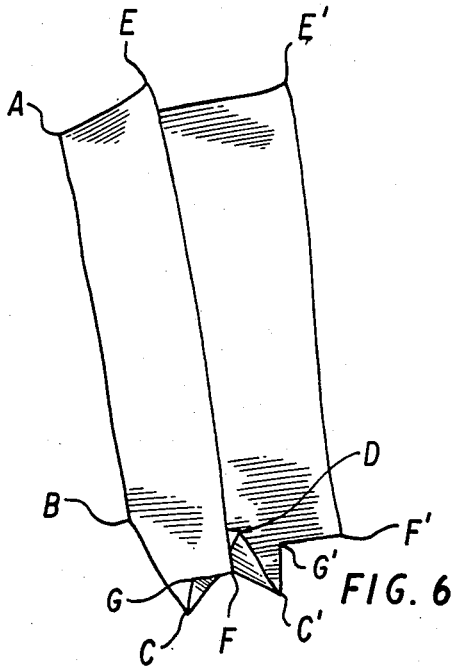
FIG. 6 is a view showing the folding step forming the inside reverse fold.
Figure 7:
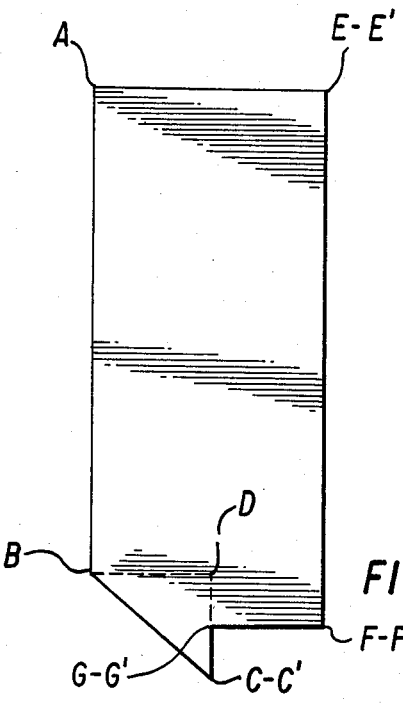
FIG. 7 is a view showing the folded condiment container.
Figure 8:
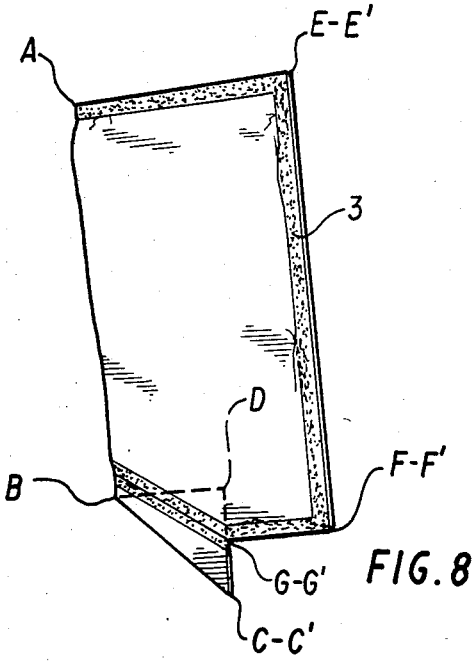
FIG. 8 is a view of the filled and heat sealed condiment container.

Referring now to FIG. 5 there is shown a blank 5 of material for forming an easy opening condiment container, which is similar to that shown in FIGS. 1–4 except that triangular die cut section 2 is replaced by rectangular die cut section 6. The easy opening condiment container shown in FIG. 8 is developed from the blank 5 with rectangular section 6 just as the easy opening condiment container of FIGS. 3 and 4 was developed. A valley fold is made along the line A-B, a crease fold is made along the line B-D and these, along with two valley folds along the lines B-C and B-C′ are used to form the inside reverse fold as the crease fold B-D is formed into a mountain or peak fold while the condiment container is being formed, as is shown in FIG. 6. The condiment container, prior to heat sealing is shown in FIG. 7 and is closed by heat seals made along the line E-E′—F-F′, the four thickness line B-G—G′ and the line F-F′-G—G′. After filling, a heat seal made along A-E—E′ completes the container as shown in FIG. 8.

Figure 9:
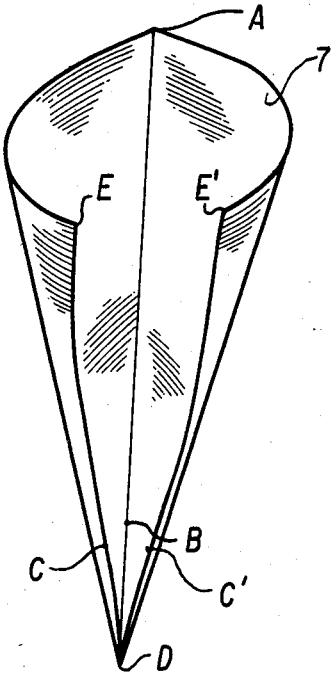
FIG. 9 is a view of a triangular blank for forming a condiment container showing the first folding step.
Figure 10:
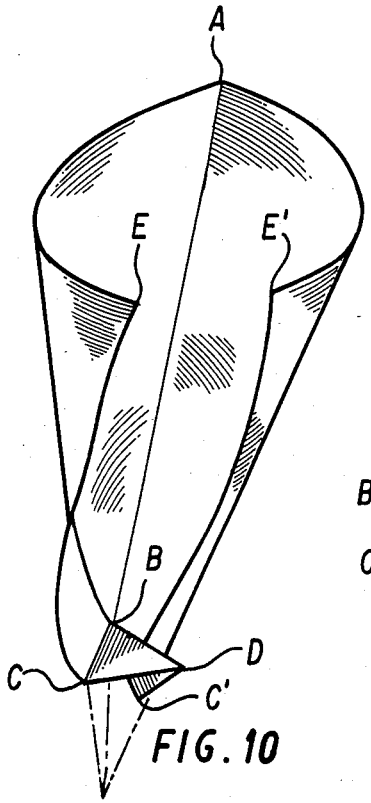
FIG. 10 shows the forming of the inside reverse fold in this condiment container.
Figure 11:
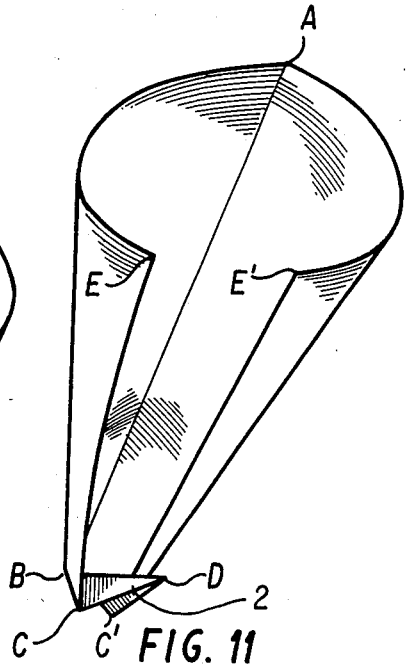
FIG. 11 shows further development of the inside reverse fold.
Figure 12:
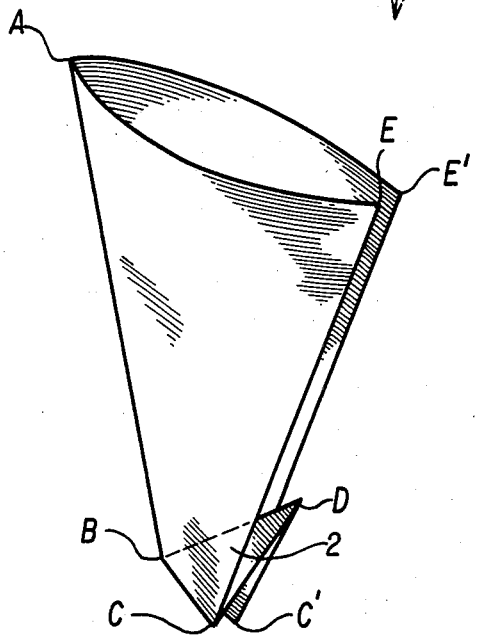
FIG. 12 shows completion of the condiment container folding steps.
Figure 13:
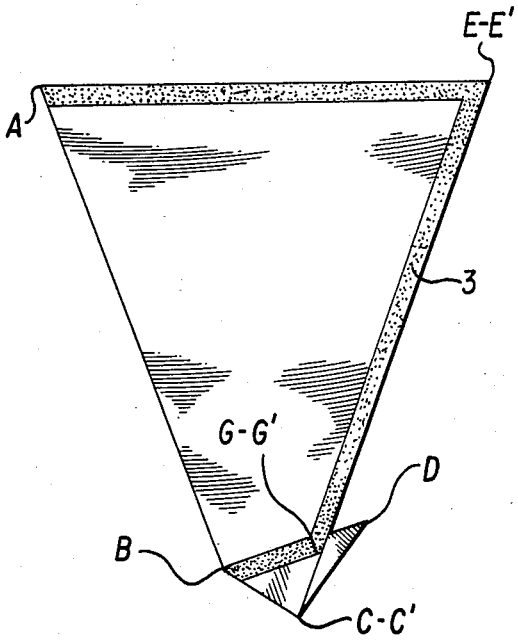
FIG. 13 shows the filled and heat sealed condiment container.

The two embodiments of the invention disclosed in FIGS. 1 thru 8 require that a die cut blank be used as the pattern for fabrication into an easy opening condiment container. The following embodiments of the invention disclose forms which do not require die cutting and which are more readily fabricated using the high speed packaging machinery currently employed to make and fill disposable portion control condiment containers. Referring to FIG. 9 there is shown an easy opening condiment container , in the process of fabrication, which is formed from a triangular pattern of sheet material 7. This form has considerable economic significance because two patterns may be cut from a single width of roll stock by making one diagonal and two horizontal cuts, without the need for steel rule dies. Using the same letters to define the fold lines and the same basic inside reverse fold, the easy opening condiment container is formed by making valley folds along the line B-C and B-C′, a crease fold along the line B-D and creating the inside reverse fold by using the crease fold as a mountain fold to create the inside reverse fold as shown in FIGS. 10, 11, and 12. Heat seals are then made along the line E—E′—G—G′ and the four thickness line B -G—G′. After filling the condiment container is closed by heat sealing along the line A-E—E′.

The three embodiments of the invention disclosed in drawings 1–13 , feature the external tab 4 which is pulled to open the condiment container along the four thickness, heat sealed tear line. This convenience is opening is eminently suitable for applications of the condiment container where the condiment containers are boxed and shipped in neatly aligned form, as they would be when employed for such uses as packaging unit doses of medicine containing controlled substances, for example.

In the high volume world of condiment containers for comestibles such as ketchup, salad dressings, table syrups and the like, the condiment containers are not boxed and shipped in rows or stacks, but may be simply thrown together in cartons and shipped. The easy opening feature of the prior embodiments, i.e. the extended tabs 4 may become a liability in these applications. During handling and shipment the tabs 4 of the condiment containers may lock together and with subsequent rough handling of the carton containing the condiment containers they may open themselves, dispensing the contents within the carton.

For applications which might involve rough handling of the easy opening condiment container it becomes necessary to conceal the opening tab 4, providing a condiment container having a smooth outside contour with no projections to catch and cause premature opening. This is accomplished in the following two embodiments of the invention, which disclose the identical opening tab 4 of the previous embodiments, but conceal it within the condiment container so that the filled condiment container presents a smooth exterior with no protruding surfaces.

Figure 14:
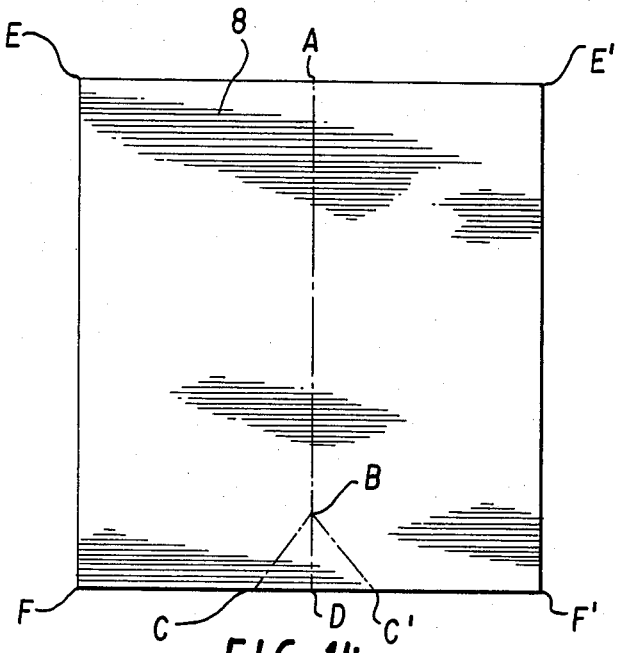
FIG. 14 shows a rectangular blank for forming a condiment container.
Figure 15:
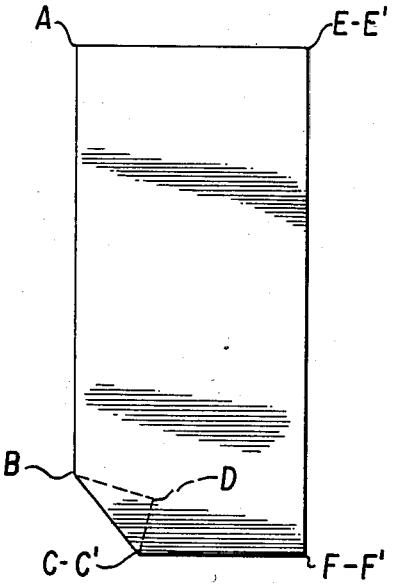
FIG. 15 shows the first folding step.
Figure 16:
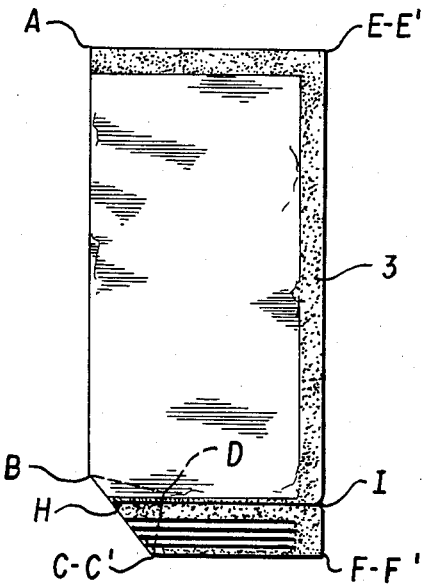
FIG. 16 shows the filled and heat sealed condiment container with concealed inside reverse fold.

Referring now to FIG. 14, there is shown a rectangular sheet of thermoplastic material 8, having the corners E and E′ and F and F′. The sheet is folded as shown in FIG. 15, as the inside reverse fold is made along the lines B G, B-G′ and B-D, in the same manner as previously discussed. The condiment container is then heat sealed along the line H-I and with a wide crimp heat seal along C-C′—F-F′ and a seal along the line E-E′—F-F′. After filling, the condiment container is sealed by a heat seal made along the line A-E—E′. It will be seen that the same inside reverse fold, which forms the easy opening feature, as shown in the previous embodiments discussed, exists in this condiment container at B-D, D-C—C′ and C-C-B. The protruding tab 4, previously discussed, has been extended by virtue of the heat seals made along H-I and C—C′-F—F′ to the edge of the condment container and is now concealed. The non heat sealed strip between the seal H and I and the C—C′-F—F′ seal and the notch in the heat seal along E—E′—F—F′ provide an initial tear line to gain access to the four thickness tear line of the inside reverse fold, which provides the opening into the condiment container.

While the foregoing embodiments of the invention disclose portion controlled condiment containers, formed by folding together materials and incorporating an inside reverse fold, a technique suitable for some packaging machinery currently employed in the industry, other condiment container forming and filling machinery uses two separate rolls of material to form condiment containers by heat sealing along all four sides of the condiment container.

Figure 17:
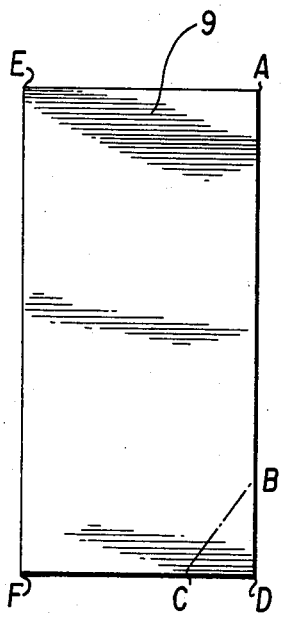
FIG. 17 shows one blank for forming a condiment container from one sheet of material.
Figure 18:
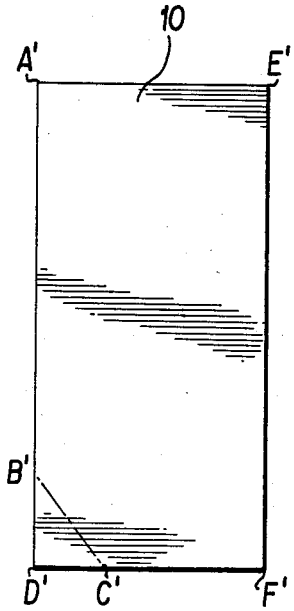
FIG. 18 shows the mirror image of the blank formed from a second sheet of material.
Figure 19:
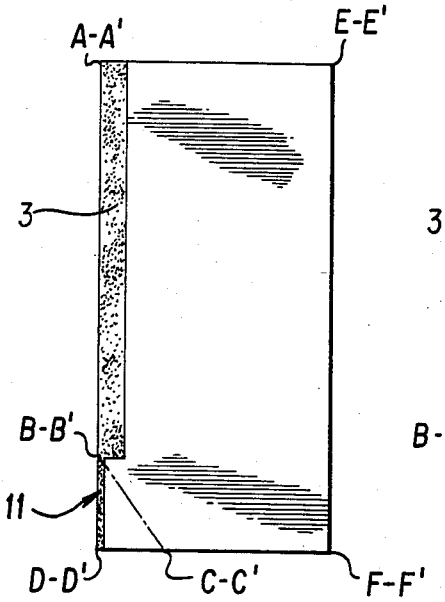
FIG. 19 shows the blanks combined and first heat seals made.
Figure 20:
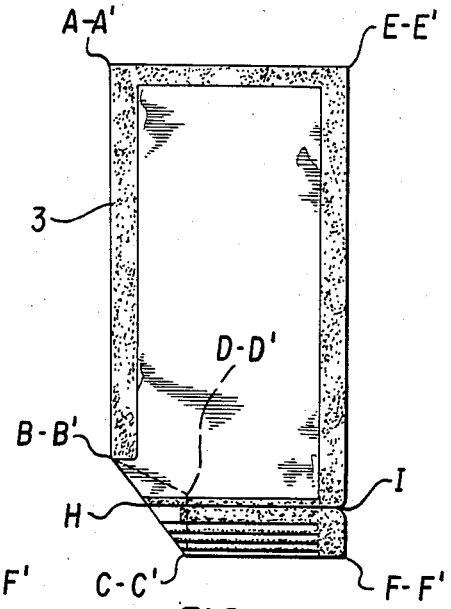
FIG. 20 shows the filled and heat sealed condiment container with concealed inside reverse fold.

The easy opening feature disclosed using the inside reverse fold can be employed using this machinery, as may be seen by examination of FIGS. 17 through 20. Referring to FIG. 17 there is shown one blank of a plastic sheet 9, which will form one side of the condiment container, while in FIG. 18 its mirror image 10 is shown which forms the other side of the condiment container. The two are brought together so that the inner surfaces match as shown in FIG. 19 and a wide heat seal 3 is made along the line A—A′-B—B′. A very thin heat seal 11 ( typically 1 mil wide ) is made along the line B—B′—D—D′. This heat sealed edge 11 now is now used to form the crease fold employed in making the reverse fold shown in FIG. 20. The container is then heat sealed along the line H-I and with a wide crimp seal along C—C′—F—F′ and a seal along E—E′—F—F′. After filling the container is sealed by a seal made along A—A′—E—E′. As in the previous embodiment the non heat sealed strip between the seals H-I and C—C′—F—F′, together with the notch in the heat seal at I provide an initial tear line to gain access to the four thickness tear line of the inside reverse fold.

What is claimed is:

1. A method of making an easy opening, disposable condiment container comprising the steps of:

folding a sheet of heat sealable, thermoplastic material;

forming an inside reverse fold at one corner of the fold line, said inside reverse fold being made by making two valley folds and a crease fold and using the crease fold as a peak fold to create the inside reverse fold defining a four thickness layer of material and said inside reverse fold extending beyond the portion of the container which will hold the contents thereof;

heat sealing the four thickness layer of the inside reverse fold to form a tear line along the heat seal for opening the container;

providing opening means for the container connected to the four thickness heat seal defining the tear line;

forming an open container by a heat seal extending from the four thickness heat seal and additional heat seals as required by the shape of the sheet;

filling the container and completing the container by a heat seal made along the edge of the open container.

2. The container formed by the method of claim 1 wherein the sheet is a rectangle with a die-cut extending section, said die cut section forming a part of the inside reverse fold and the four thickness layer of material and the opening means is a tab connecting the tear line along the heat seal with this extending section.

3. The container formed by the method of claim 1 wherein the sheet is triangular, forming the inside reverse fold at the vertex thereof and opening means is a tab formed by this vertex fold connecting the tear line along the heat seal with this tab.

4. The container formed by the method of claim 1 wherein the sheet is a rectangle and the inside reverse fold is formed along a portion of the fold line, opening means being provided by extending heat seals from the four thickness heat seal to the opposite edge of the container to form a tear line connecting that edge to the tear line formed by the four thickness heat seal.

5. A method of making an easy opening, disposable condiment container comprising the steps of:

joining two sheets of heat sealable, thermoplastic material by a wide heat seal along a portion of one of the edges thereof and a narrow heat seal along the remaining portion of that edge;

forming an inside reverse fold by making two valley folds and making a crease fold along the narrow heat seal, using the crease fold as a peak fold to create the inside reverse fold defining a four thickness layer and said inside reverse fold extending beyond the portion of the container which will hold the contents thereof;

heat sealing the four thickness layer of the inside reverse fold to form a tear line along the heat seal for opening the container;

extending heat seals from the four thickness heat seal to the opposite edge of the container to connect that edge to the four thickness heat seal and provide opening means therefore;

forming an open container by sealing the opposite edge;

filling the container and completing the container by heat sealing the remaining open edge.

6. The container formed by the method of claim 5 wherein the sheets are rectangular.

* * * * *